US007716749B2

(12) United States Patent
Perazzo

(10) Patent No.: US 7,716,749 B2
(45) Date of Patent: May 18, 2010

(54) DINING GARMENT FOR A HIGH CHAIR

(76) Inventor: John S. Perazzo, 1426 Waltham Dr., Southlake, TX (US) 76092

( * ) Notice: Subject to any disclaimer, the term of this patent is extended or adjusted under 35 U.S.C. 154(b) by 0 days.

(21) Appl. No.: 12/250,247

(22) Filed: Oct. 13, 2008

(65) Prior Publication Data

US 2010/0088796 A1 Apr. 15, 2010

(51) Int. Cl.
*A41B 13/10* (2006.01)

(52) U.S. Cl. ..... 2/49.1; 2/49.2; 2/49.3

(58) Field of Classification Search ..... 2/49.1, 2/49.3, 49.2, 49.4, 49.5, 48, 50, 51, 52, 46, 2/114, 174; 297/182, 153; 4/519–521, 655, 4/658, 580, 581, 583, 245.1, 245.3–245.5, 4/245.7–245.9

See application file for complete search history.

(56) References Cited

U.S. PATENT DOCUMENTS

| | | | | | |
|---|---|---|---|---|---|
| 83,120 | A | * | 10/1868 | Mott | 2/49.5 |
| 1,108,557 | A | | 8/1914 | Dudley | |
| 2,321,670 | A | * | 6/1943 | Gibson | 2/49.4 |
| 2,457,725 | A | | 12/1948 | Rhowmine | 2/49 |
| 2,629,871 | A | * | 2/1953 | Greene | 2/51 |
| 2,643,384 | A | | 6/1953 | Thompson | 2/49 |
| 2,672,614 | A | | 3/1954 | Zimmerman et al. | 2/49 |
| 2,738,511 | A | | 3/1956 | Brady | 2/49 |
| 2,762,053 | A | | 9/1956 | Lipscomb | 2/49 |
| 2,766,455 | A | | 10/1956 | Klaine | 2/49 |
| 2,767,403 | A | | 10/1956 | Givens | 2/49 |
| 2,822,548 | A | | 2/1958 | Rhowmine | 2/49 |
| 2,905,943 | A | | 2/1959 | Carlisle | 2/49 |
| 3,597,763 | A | * | 8/1971 | Bienvenu | 2/49.3 |
| 4,094,547 | A | * | 6/1978 | Zampino et al. | 297/182 |
| 4,114,199 | A | | 9/1978 | Malan | 2/49 |
| 4,165,123 | A | * | 8/1979 | Hutson | 297/153 |
| 5,146,629 | A | * | 9/1992 | Barnes | 2/174 |
| 5,469,580 | A | * | 11/1995 | Sobol | 2/56 |
| 5,915,530 | A | | 6/1999 | Hager | 2/49 |
| 6,128,781 | A | * | 10/2000 | Spindler | 2/49.3 |
| 6,532,595 | B1 | | 3/2003 | Holmes | 2/48 |
| 6,581,210 | B2 | * | 6/2003 | Kaloustian | 2/49.1 |
| 6,708,341 | B1 | * | 3/2004 | Schaller | 2/51 |
| 7,469,425 | B2 | * | 12/2008 | DeStefano | 2/49.3 |
| 7,484,249 | B1 | * | 2/2009 | Reese et al. | 2/48 |

* cited by examiner

*Primary Examiner*—Amy B Vanatta
(74) *Attorney, Agent, or Firm*—Whitaker, Chalk, Swindle & Sawyer, LLP; Stephen S. Mosher

(57) ABSTRACT

A dining garment for a child's high chair or toddler's table or other similar furniture article, comprises a tray cover, a bib extension of the tray cover extending over the tray, and a bolster disposed around and extending upward from the perimeter of the tray cover, the combination forming a basin. The bolster has sufficient rigidity to maintain the basin form and sufficient flexibility to facilitate installation, removal, and cleaning, without requiring inflation of the bolster and without requiring a separate supporting frame. The dining garment includes a trough between the tray cover and the bib extension for accumulating spilled food materials. A drain may be provided in the trough for draining the spilled material. The drain may include a cap, stopper, or plug.

16 Claims, 7 Drawing Sheets

12
14
16
18
20
22
60
62
100
102
104
106
108
120
122
124
126
128
130
132

DINING GARMENT FOR A HIGH CHAIR

BACKGROUND OF THE INVENTION

1. Field of the Invention

The present invention generally relates to dining or bib garments for use during meals and more particularly to a combined bib and tray cover for a high chair or similar article of furniture.

2. Description of the Prior Art

A variety of bib garments have been developed or proposed for use by a person seated in a dining situation. Typically, such bibs are provided for use by infants or young children to protect their clothing and/or furniture from food and liquid spills, drooling, and the like. Bibs are often equipped with an apron or other extension to spread over a tray or table or under dishware to enhance their utility. In some examples, the extended bib has fence-like sides attached to better retain food items discarded or not yet eaten from leaking or falling off or being pushed away from the bib or its extension.

Such foregoing features are disclosed in the prior art, including the following representative examples. U.S. Pat. No. 2,672,614 issued to Zimmerman et al describes a "Bib" having a curved form to fit around the body of the wearer. A tray panel is provided around the lower portion of the bib. The tray panel has a bottom surface and a reinforced "upstanding flange" extending from the perimeter of the bottom surface, which is connected to a lower side of the bib nearest its rearward edges, forming a container to catch and retain food particles or liquid foods.

U.S. Pat. No. 2,738,511 issued to Brady describes a one-piece bib that has a tray portion extending from the lower part of the bib that includes a pocket on the underside that may be slipped over the tray and pulled rearward until the tray is completely enclosed by the pocket. The bib is also configured to form a second pocket at the lower portion of the bib between the near edge of the tray and the bib to catch food particles and liquids. A bowl retainer comprising a circular piece of flexible material having an outer peripheral edge, which includes a drawstring, is provided to secure a bowl of food to the top side of the tray portion of the bib.

U.S. Pat. No. 2,762,053 issued to Lipscomb for a "Bib with Tray Cover." The tray cover includes an elastic band around its perimeter so that the perimeter of the tray cover may be pulled over and under the tray edge to secure the tray cover. The bib and tray cover is constructed without gathers in the materials extending across the bib portion at the rear of the tray or between the child wearing the bib and the tray, to avoid surfaces in which liquid or other foods could lodge and be difficult to remove. A basin-like pocket is provided at the lower end of the bib when the high chair tray is positioned properly with respect to the front of the child wearing the bib and tray cover. The bib and tray cover may be constructed of a single piece of flat material.

U.S. Pat. No. 2,766,455 issued Klaine for an "Infant's Bib and Auxiliary Tray" having inflatable, tubular sidewalls which serve to form a confining basin extending over the upper surface of the tray of the high chair. A tray frame is required for supporting the auxiliary tray in position. The confining basin may be collapsed for storage. The tray cover itself is preferably formed of a sheet of flexible plastic material. A valve is provided for inflating and deflating the inflatable sidewalls.

U.S. Pat. No. 2,822,548 issued to Rhowmine describes an improved one-piece "Child's Bib and Tray Cover" (See same inventor's U.S. Pat. No. 2,457,725). The tray cover includes an elastic band around its perimeter to secure it to a tray. The improved bib and tray cover includes, in place of the string ties to secure the bib to the child, an elastic band and strip such that the shoulder straps of the bib may be stretched to slip the bib over the child's head and arms.

U.S. Pat. No. 2,905,943 issued to Carlisle et al describes a "Combined Bib and Apron." The apron portion is configured to fit over the tray of a high chair and secured by elastic strips around the edge of the apron. The one piece bib and apron includes sufficient material to provide a trough between the child's waist and the near edge of the tray of the high chair. The combined bib and apron is made of a single sheet of waterproof material.

The foregoing bib-and-apron combinations have one or more of the following inconvenient features. Those that have a sidewall either require inflation of the sidewall and a supporting frame for the sidewall, a stiffener internal to a laminated sidewall, or lack any kind of support for the sidewall. Thus, the sidewall feature requires a set up operation to use, is insufficiently flexible or has relatively hard edges, or the sidewall is rendered ineffective as a containing mechanism because of its lack of support. In addition, those bib-and-apron combinations that are reusable require bailing out of the trough or basin, or removal from the high chair, to dispose of spilled food items. What is needed is a bib and tray cover combination that solves these problems and increases the utility and ease of use without diminishing the comfort to the child that is using it.

SUMMARY OF THE INVENTION

Accordingly there is provided a dining or bib garment for a child's high chair or toddler's table or other similar furniture article, comprising a tray cover shaped conformably to the outline of the tray and covering the tray, a bib extension of the tray cover extending upward from a rearward side of the tray cover, and a bolster disposed around and extending upward from the perimeter of the tray cover on the left, forward, and right sides thereof, wherein a first end and a second end of the bolster are attached to the bib extension at respective left and right sides thereof, thereby collectively forming a basin comprising the tray cover, bolster and bib extension in combination.

In one aspect of the present invention, the bolster has sufficient rigidity to maintain the basin form while retaining sufficient flexibility to facilitate installation, removal, and cleaning of the dining garment, without requiring inflation of the bolster and without requiring a separate supporting frame. The tray cover, bib extension and bolster are formed of a water repellant fabric, and the bolster given form by a resilient stuffing material disposed therewithin.

In another aspect, the dining garment includes a trough formed along a rearward edge of the tray cover and disposed between the tray cover and a lower portion of the bib extension for accumulating liquid or liquid-and-solid mixtures spilled upon the tray cover or the bib extension.

In yet another aspect of the present invention, there is provided a drain passage disposed in a lowermost portion of the trough for routing liquids or liquid-and-solid mixtures away from the trough. The drain passage may include a spout and plug assembly disposed at an outlet portion of the drain passage for closing the drain passage. The drain passage may alternatively include a spigot and plug assembly or a nipple and cap assembly disposed at an outlet portion of the drain passage for closing the drain passage.

In yet another aspect of the present invention, the dining garment may include an apron of the tray cover having an elastic edge for securing the dining garment around and under the edge of the tray.

DETAILED DESCRIPTION OF THE INVENTION

An illustrative embodiment of the novel dining garment or bib-and-tray cover combination for use with a child's high chair, toddler's table, or similar article of furniture is described as follows with the aid of the appended drawings. In this description, structures identified in the figures with the same reference numbers are identical structures. The embodiment described is presented to illustrate the concepts of the present invention. However, the invention is not intended to be limited to the one embodiment described herein. For example, it is contemplated that the dining garment described herein may be used by older children or adults in circumstances where its use would be advantageous, such as dining facilities for persons with disabilities or special needs, etc.

Figure 1:
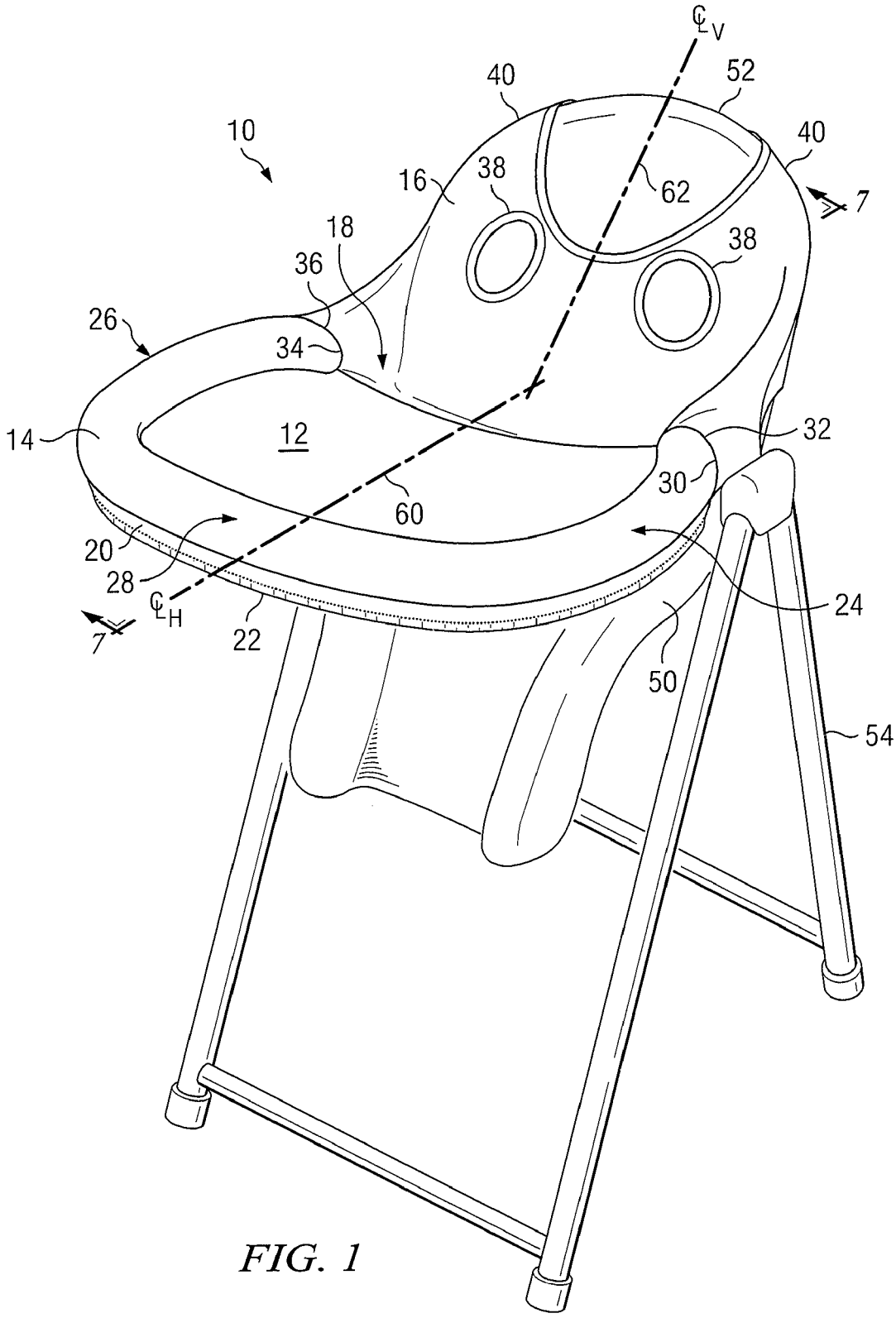
FIG. 1 illustrates a perspective view of one embodiment of a dining garment for a child's high chair according to the present invention.

Referring to FIG. 1, there is illustrated a perspective view of one embodiment of a dining garment for a child's high chair according to the present invention. The dining garment 10 is shown installed on a high chair 50, which includes a seat back 52 and legs 54 for supporting the high chair 50. The dining garment 10 includes a tray cover 12, a bolster 14, and a bib extension 16. The tray cover 12 is configured to fit over a tray portion 100 of the high chair 50 (the tray portion 100 is illustrated in cross section in FIG. 7). The tray cover 12 is further shaped to substantially conform to the shape of the tray portion 100 of the high chair 50. The tray cover 12 includes an apron 20 attached to the underside of the tray cover 12 around the perimeter of the tray cover 12 that is configured to surround the side and front edges of the tray portion 100. An elastic band 22 included along the lower edge of the apron 20 facilitates securing the tray cover to the tray portion 100 of the high chair 50.

The bolster 14 is a tubular structure containing a resilient stuffing 102, which is attached to the perimeter of the tray cover 12 along the side and front edges of the tray cover. The resilient stuffing 102 (see FIG. 7) maintains the tubular shape of the bolster 14 as it loops around the perimeter of the tray cover 12, yet retains sufficient flexibility to allow the bolster 14 to be bent during installation or removal of the dining garment 10. The bolster 14 functions as a sidewall or fence around the perimeter of the tray cover 12. The bolster 14 has a first end 30 and a second end 34, which respectively join the bib extension 16 at the locations 32 (left side of the bib extension 16) and 36 (right side of the bib extension 16.

The bib extension 16, which is provided to cover the torso of the child seated in the high chair, is, joined to and may be contiguous with, the rearmost portion of the tray cover 12. When the dining garment 10 is installed and a child seated in the high chair, the fabric of the dining garment has sufficient excess material to provide a trough 18 in the space between the rearmost portion of the tray cover 12 and the torso of the seated child. The sides of the bib extension 16 may also be contiguous with the first 30 and second 34 ends of the bolster 14. Thus, the tray cover 12, the bolster 14, and the bib extension 16 cooperate to function as a basin 12/14/16 to contain spilled food or liquid items. The basin 12/14/16, given form by the bolster 14, includes the trough 18, which is provided primarily to contain liquid spills. Other features of the bib extension 16 include left and right armholes 38 for the child seated in the high chair 50, and left and right sides 40, which are provided to pass over the shoulders of a child seated in the high chair (see FIG. 3). Also shown in FIG. 1 are a horizontal centerline 60 and a vertical centerline 62, to be discussed in FIG. 7.

The dining garment 10 shown in the figures is preferably formed of stain and water-resistant fabric that is also machine washable. A suitable fabric, which may be identified as being suitable for "baby pants,' is a lightweight, urethane-coated, 70 Denier, 100% nylon, available from Skytex Enterprises, Inc., or www.skytexla.com. Generally, this material is easy to wipe clean. A suitable alternate material is called high count nylon taffeta. Materials containing vinyl, such as polyvinyl chloride and others, are not suitable for use in baby products in California because they may out-gas potentially harmful chemicals. The dining garment 10 may be fabricated from a single piece of fabric or from several pieces of fabric stitched together. As one example, persons skilled in the sewing arts will recognize that separate pieces of fabric may be sewn together along seams that coincide with changes in the angle formed by the different panels of material. To illustrate, seams may be used along and under the bolster 14, where the bib extension 16 joins the tray cover 12, etc. The elastic band 22 may be attached along a seam that, joins the elastic band 22 with the apron 20. Similarly, the apron 20 may be sewn to the tray cover 12. Likewise, the bolster 14 may be attached to the tray cover 12 along a sewn seam. Persons skilled in the art may readily see several possibilities for devising a suitable set of patterns.

Figures 7, 8, 8A, 8B:
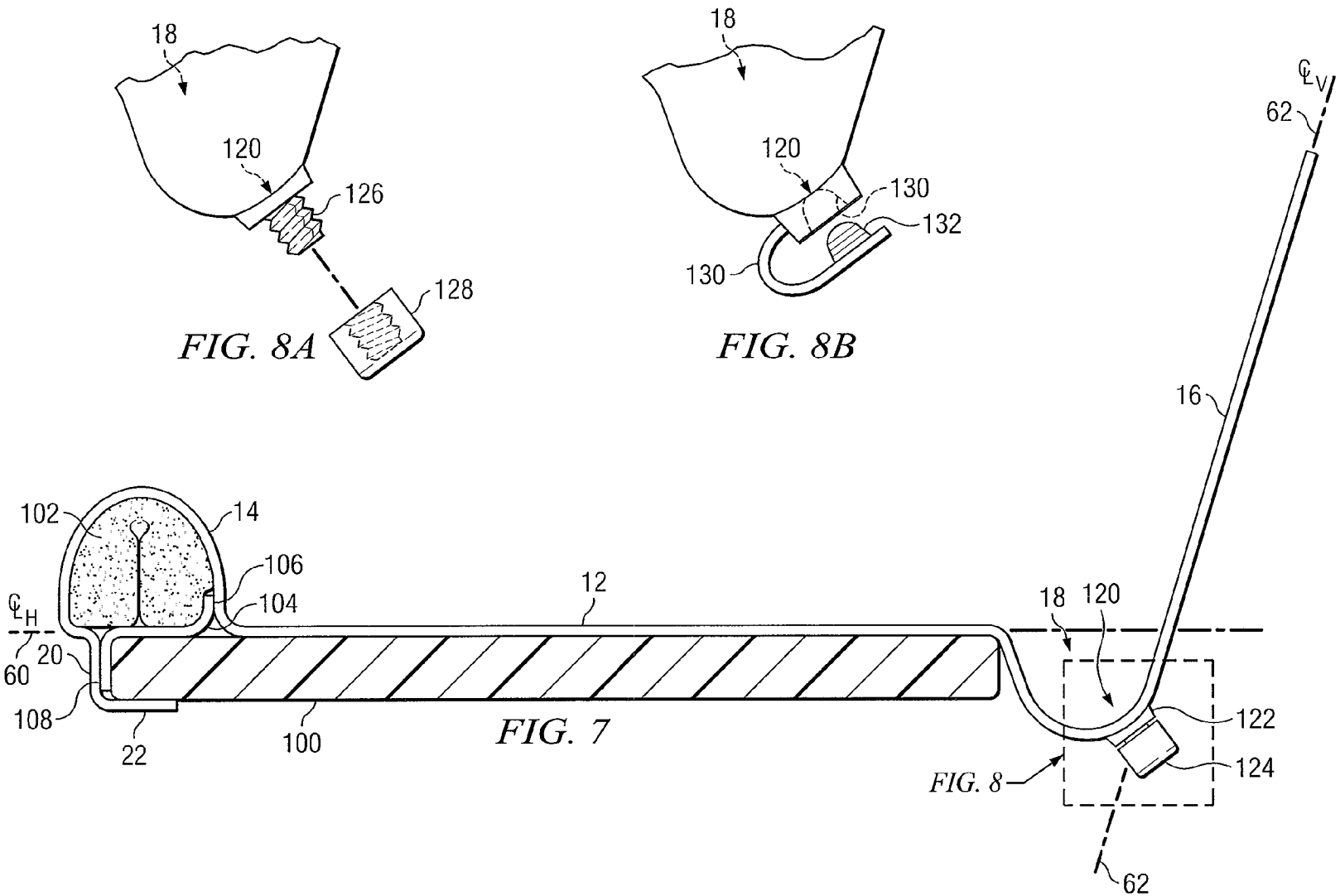
FIG. 7 illustrates a cross section view of an alternate embodiment of the dining garment of FIGS. 1, 4, and 6 that includes a trough feature having a drain mechanism according to the present invention.
FIG. 8A illustrates a side view of a first embodiment of a drain mechanism for use with the trough feature illustrated in FIG. 7.
FIG. 8B illustrates a side view of a second embodiment of a drain mechanism for use with the trough feature illustrated in FIG. 7.

The resilient stuffing 102 for the bolster 14 may be a resin-bonded polyester quilt batting, such as is available from Hobbs Bonded Fibers, Waco, Tex. 76702, or www.hobbsbondedfibers.com. In the following description, the terms resilient stuffing and batting (or batting material) are synonymous and both referred to by the reference number 102. The stuffing or batting 102 is shown in FIG. 7. As is known in the art, after the fibers to be used in the batting 102 are carded and formed into a web-like layer, a resin bonding process applied to the fibers maintains the web-like form of the fibers in the batting 102 to resist migration and shifting of the fibers. Another important reason for selecting this batting material 102 is that it does not absorb or retain water, and thus inherently retards the formation of mold, etc. In this particular application, the batting 102 may preferably be a relatively high loft batting material 102. Other materials having similar properties are acceptable. As with any material used in the construction of items of apparel or furniture for use by infants, children, or even adults, the materials must be non-toxic, non-flammable, etc. In constructing the bolster 14, it is suggested that the tube-like outer shell of the bolster 14 be filled with a strip of batting material 102 folded lengthwise once to provide the appropriate balance of resiliency and stiffness. However, some applications may work well if the batting material is formed into a roll, with the longer sides overlapping.

In use, after the child is seated in the high chair 50, the tray 100 is positioned on the high chair 50 and the tray cover 12 of the dining garment 10 is placed over the tray 100 and secured using the elastic band just under the outer edge of the tray 100. The bib extension 16 is placed over the child's torso and lap. Then, the trough 18 formed in the portion of the dining garment 10 between the rear most edge of the tray 100 and the torso of the child, is positioned toward the child's lap. After the child's arms are inserted through the arm holes 38, the ends of the sides 40 or shoulder straps 70 may be secured at the joint 42, 72. During use, if spilled liquid materials accumulate in the trough 18, the capping device 124 of the drain passage 120 may be removed temporarily to drain the liquid from the trough 18 and basin formed by the tray cover 12, bolster 14, and bib extension 16. After use, any debris accumulated in the basin portion of the dining garment 10 may be poured into a waste receptacle or washed away.

Figure 2:
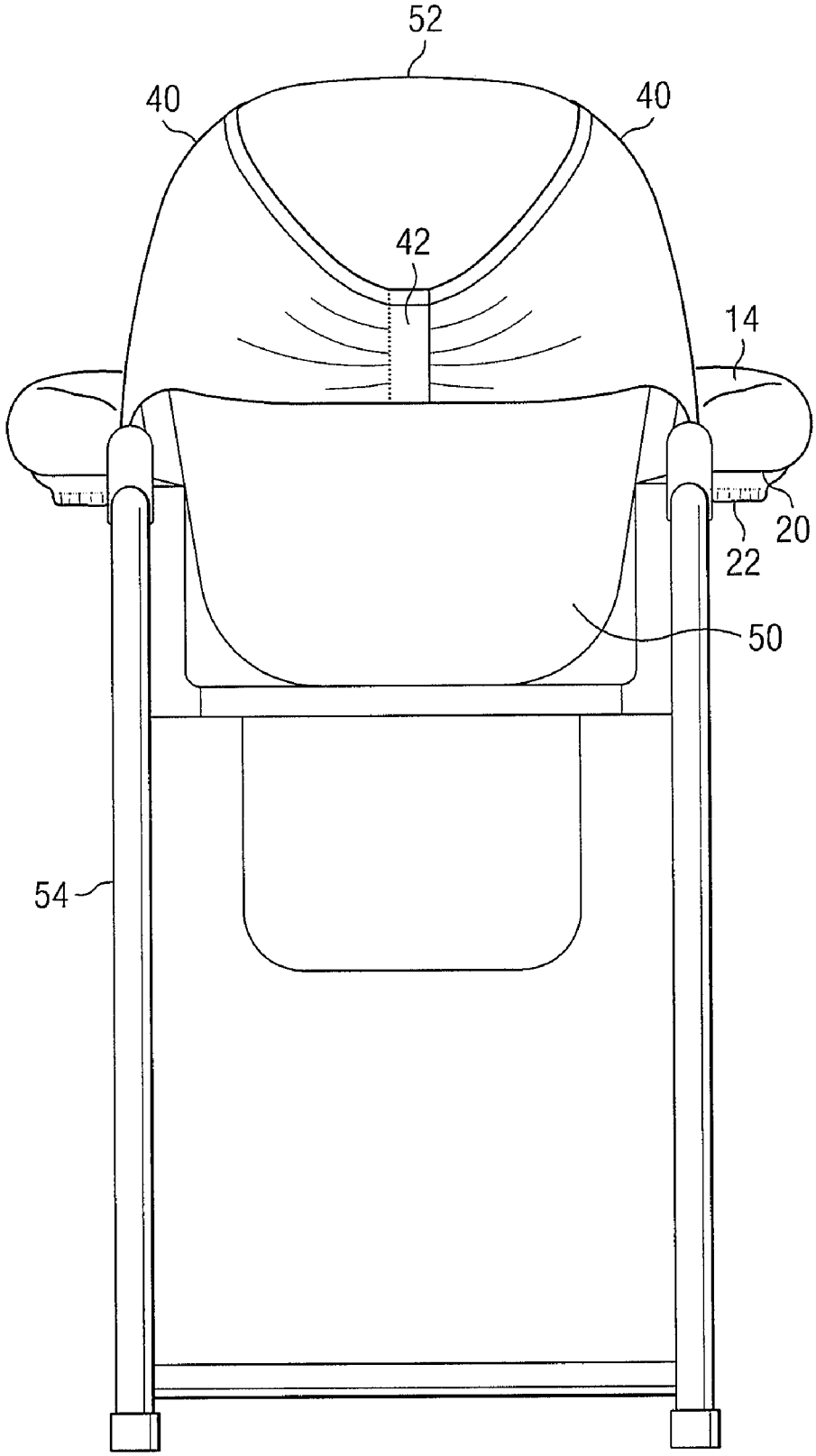
FIG. 2 illustrates a rear view of the embodiment of FIG. 1.

Referring to FIG. 2, there is illustrated a rear view of the embodiment of FIG. 1. In this view, the left and right sides 40 of the dining garment 10 are shown wrapped around the seat back 52 of the high chair 50 and connected together at a joint 42. The joint 42 may be secured using a snap, hook-and-loop, button, zipper, belt, tie-string or other similar fastener. All other structural features of the dining garment 10 visible in FIG. 2 are as described for FIG. 1.

Figure 3:
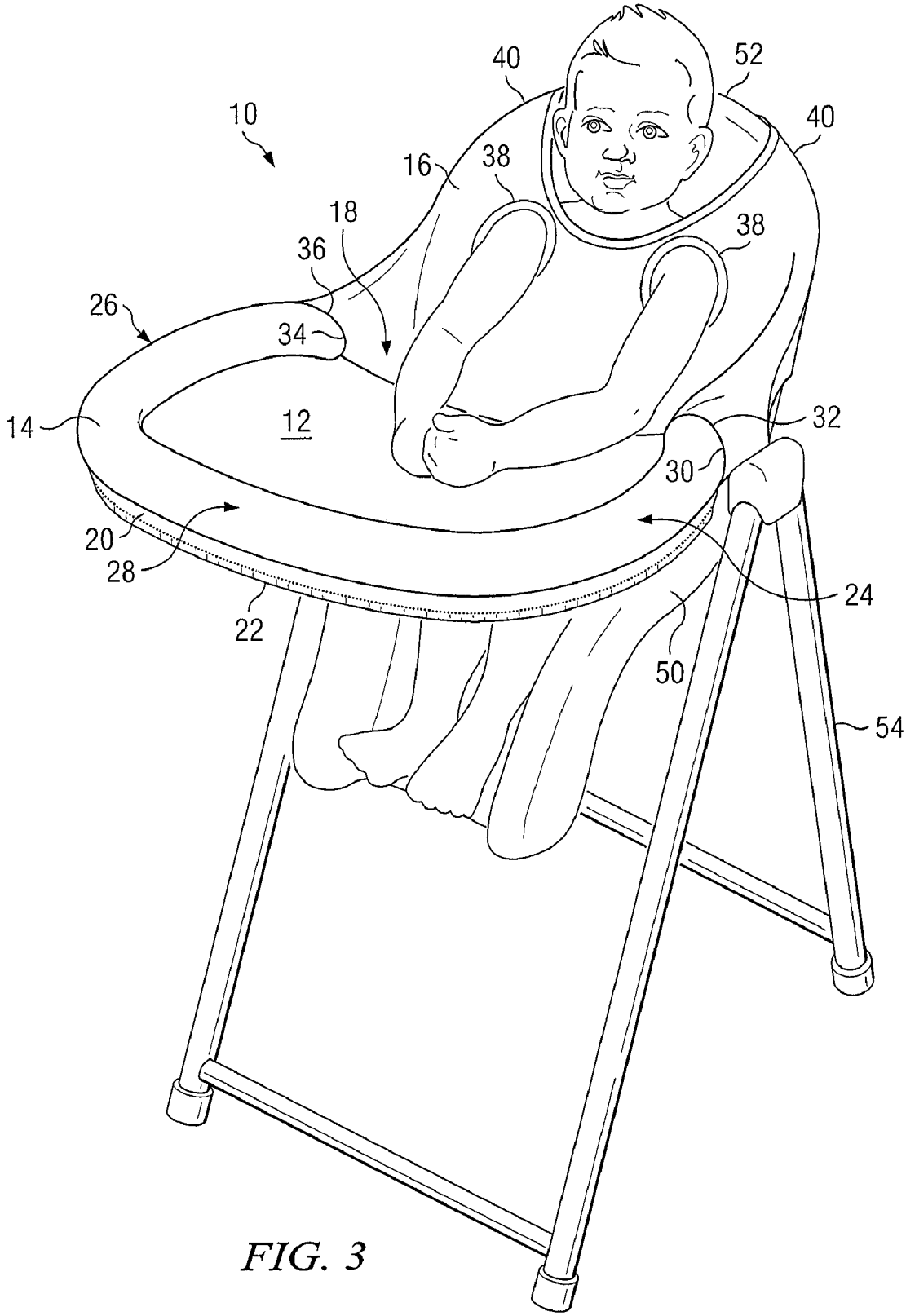
FIG. 3 illustrates a perspective view of the embodiment of FIG. 1 in use by a child seated in the high chair.

Referring to FIG. 3, there is illustrated a perspective view of an example of use of the embodiment of FIG. 1, by a child seated in the high chair 50. All other structural features of the dining garment 10 are as described for FIG. 1.

Figure 4:
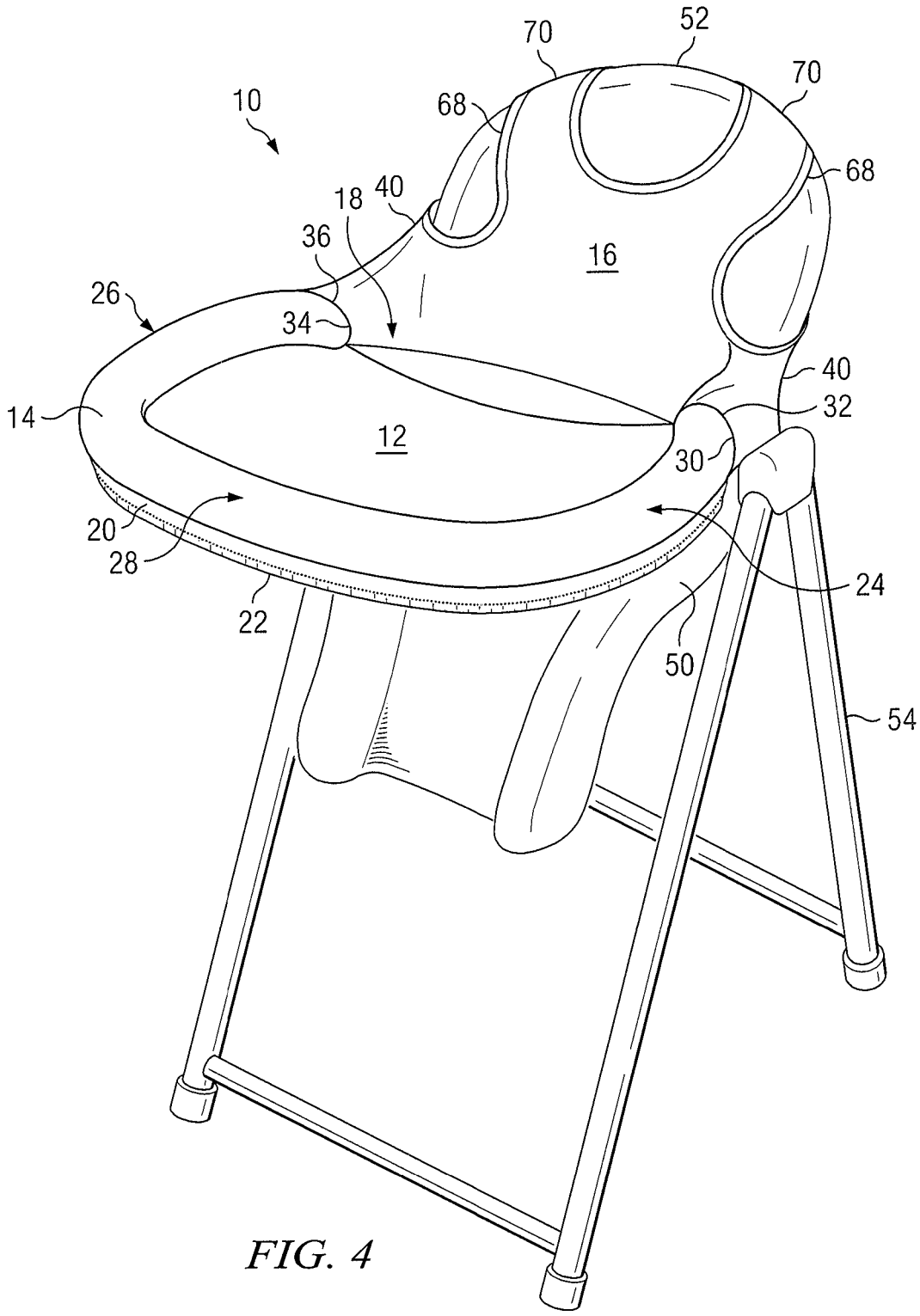
FIG. 4 illustrates a perspective view of an alternate embodiment of the dining garment for a high chair according to the present invention.

Referring to FIG. 4, there is illustrated a perspective view of an alternate embodiment of the dining garment 10 for a high chair 50 according to the present invention. In the embodiment shown, the bib extension 16 has larger left and right arm holes 68, such that the upper portion of the left and right sides 40 become left and right shoulder straps 70. The shoulder straps 70 pass over the shoulders of a child seated in the high chair 50 and around the seat back 52. All other structural features of the dining garment 10 visible in FIG. 4 are as described for FIG. 1.

Figure 5:
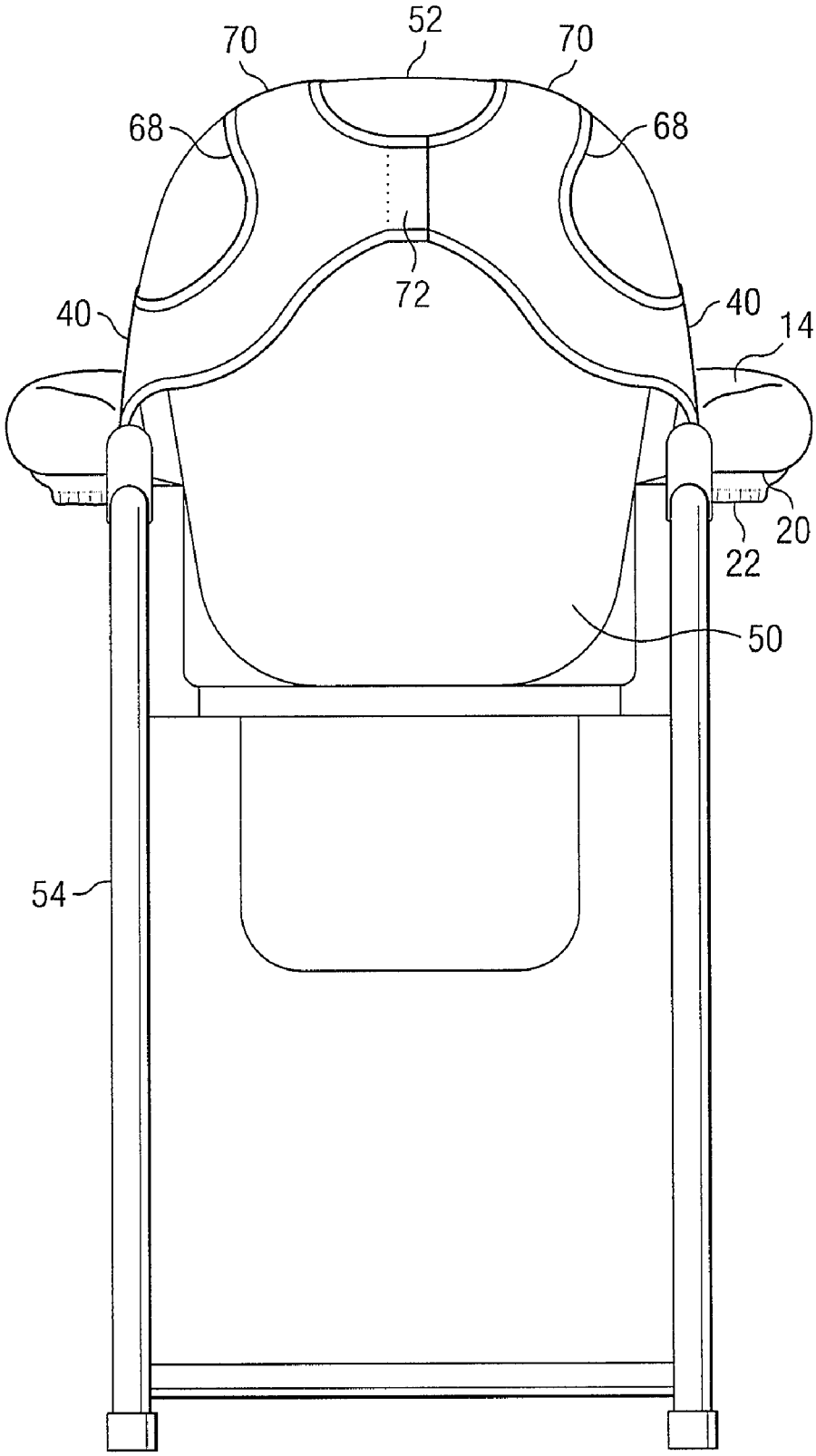
FIG. 5 illustrates a rear view of the embodiment of FIG. 4.

Referring to FIG. 5, there is illustrated a rear view of the embodiment of FIG. 4. In this view, the left and right sides 40, and the left and right shoulder straps 70 of the dining garment 10 are wrapped around the seat back 52 of the high chair 50 and shown joined together and connected together at a joint 72. The joint 72 may be secured using a snap, hook-and-loop, button, zipper, belt, tie-string or other similar fastener. All other structural features of the dining garment 10 visible in FIG. 5 are as described for FIG. 1.

Figure 6:
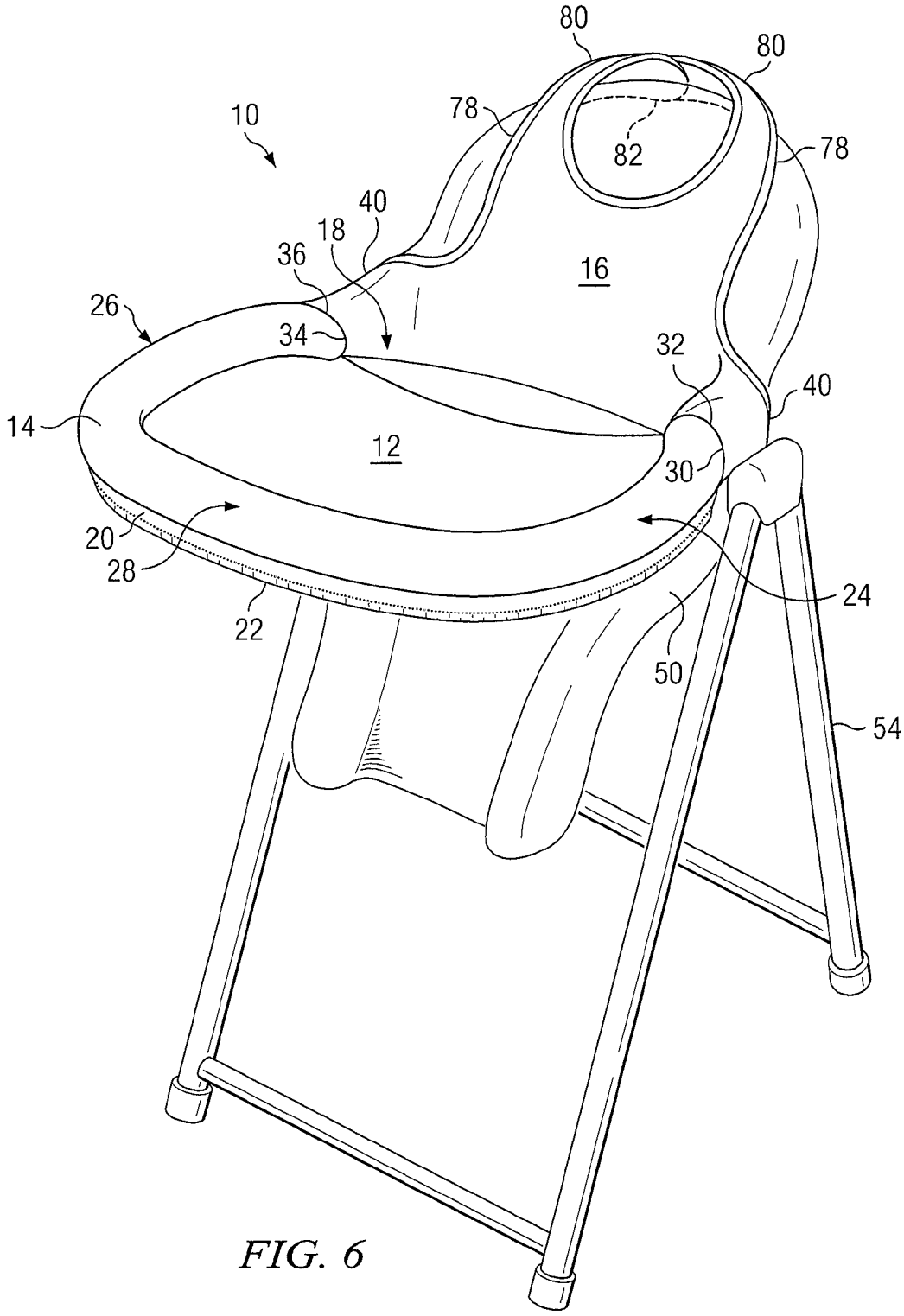
FIG. 6 illustrates a perspective view of another alternate embodiment of the dining garment for a high chair according to the present invention.

Referring to FIG. 6, there is illustrated a perspective view of another alternate embodiment of the dining garment 10 for a high chair 50 according to the present invention. In the embodiment shown, the bib extension 16 has larger left and right arm holes 78, such that the upper portion of the left and right sides 40 become left and right shoulder straps 80. The shoulder straps 80 are configured to pass over the shoulders of a child seated in the high chair 50, around the person's neck just above the seat back 52, where the ends of the shoulder straps 80 may be secured at a joint 82 as illustrated by the phantom lines. The shoulder straps 80 may be secured using a snap, hook-and-loop, button, zipper, belt, tie-string or other similar fastener. All other structural features of the dining garment 10 visible in FIG. 4 are as described for FIG. 1.

FIG. 7 illustrates a cross section view of the tray portion of the dining garment 10 of FIGS. 1, 4, and 6. The view of the tray portion in FIG. 7 illustrates the structure of the bolster 14 and includes detail of the trough 18 having a drain mechanism according to the present invention. Shown in cross section are the tray 100 of the high chair 50, the bolster 14, and the trough 18, as well as the tray cover 12 and the bib extension 16. In this view, the fabric of the tray cover 12 is shown as it wraps around the resilient stuffing 102 to form the bolster 14, and also forms the apron 20 of the tray cover 12 along the edge of the tray 100. The elastic binding 22 is shown in cross section along the edge of the apron 20.

In the embodiment of FIG. 7, one of several methods of retaining the resilient stuffing 102 within the tubular sleeve of the bolster 14 includes a lower panel 104 of fabric that may be stitched to the tray cover 12 along an upper edge of the lower panel 104 at a seam 106 and to the apron 20 along a lower edge of the lower panel at a seam 108. To simplify manufacture, the upper edge of the panel 104 may be stitched first, followed by inserting the resilient stuffing 102 in the bolster 14, and finishing the operation by stitching the lower edge to the apron 20 at the lower seam 108. As described herein above, in constructing the bolster 14, it is suggested that the tube-like outer shell of the bolster 14 be filled with a strip of batting material 102 folded lengthwise once to provide the appropriate balance of resiliency and stiffness. In individual applications, the loft of the batting material 102, the tightness with which it is folded or formed into a roll, the diameter of the outer shell of the bolster 14 may be varied to achieve a desired combination of stiffness, resiliency, etc.

Continuing with FIG. 7, the trough 18 formed by the downward loop of the bib extension fabric shown in cross section includes a drain mechanism shown within the dashed line. The drain mechanism may be advantageously positioned near one side or the other of the dining garment to facilitate its use in draining fluids while the dining garment is in use. The drain mechanism includes a drain passage 120 having a tubular opening 122 and a capping device 124 for closing the drain passage 120 when the dining garment is in use or is stored after cleaning.

Referring to FIGS. 8A and 8B, there are illustrated side views of first and second embodiments of a drain mechanism for use with the trough feature illustrated in FIG. 7. In the first embodiment illustrated in FIG. 8A, the tubular opening is provided by a pipe nipple 126 and the capping device 124 is provided by a threaded cap 128. Similarly, in the second embodiment illustrated in FIG. 8B, the tubular opening is provided by a spigot 130 and the capping device 124 is provided by a press-fit plug 132. Other alternative closing mechanisms for the drain passage 120 may be considered and adapted to the structures suggested in FIGS. 7, 8A, and 8B. These may include faucets, petcocks, taps, and the like. In one alternative use of the nipple-and-cap embodiment of FIG. 8A, a hose (not shown, as it is a well known device) having a matching fitting to the nipple 126 may be attached to the drain passage 120. The hose may be routed to a bucket or other basin or receptacle.

While the invention has been shown and described in essentially one of its forms, it is not thus limited but is susceptible to various changes and modifications without departing from the spirit thereof. For example, as pointed out herein above, it is contemplated that the dining garment, or bib-and-tray cover combination described herein may be adapted for use by older children or adults in circumstances where such use would be advantageous, such as dining facilities for persons with disabilities or special needs, etc. Thus, though the tray cover may be larger or shaped differently, or the bolster configured to be stuffed more or less firmly, or the bib extension configured for older children or adults, or the trough configured for greater or less capacity, or the drain mechanism be adapted for greater flow volume or equipped with additional plumbing features to route liquid or even some debris away from the trough, all such variations and others that may differ yet embody the same basic features as recited in the claims are considered to be within the scope of the claims as set forth herein below.

What is claimed is:

1. A dining garment for a child's high chair, comprising:

a tray cover shaped conformably to the outline of a tray of said high chair covering said tray;

a bib extension of said tray cover extending upward from a rearward side of said tray cover;

a bolster disposed around and extending upward from the perimeter of the tray cover on the left, forward, and right sides thereof, wherein a first end and a second end of said bolster are attached to said bib extension at respective left and right sides thereof; wherein a basin is formed by said tray cover, bolster and bib extension;

a trough formed along a rearward edge of said tray cover and disposed between said tray cover and a lower portion of said bib extension for accumulating liquid or liquid-and-solid mixtures spilled upon said tray cover or said bib extension; and a drain passage disposed in a lowermost portion of said trough for routing liquids or liquid-and-solid mixtures away from said trough.

2. The dining garment of claim 1, wherein:

said bolster has sufficient rigidity as a frame to maintain said basin form while retaining sufficient flexibility to facilitate installation, removal, and cleaning of said cover, without requiring inflation of said bolster.

3. The dining garment of claim 1, wherein:

said tray cover, bib extension and bolster are formed of a water repellant fabric, said bolster given form by a resilient stuffing material disposed therewithin.

4. The dining garment of claim 1, wherein:

said trough is formed of a water repellant fabric.

5. The dining garment of claim 1, wherein said drain passage comprises:

a spout and plug assembly disposed at an outlet portion of said drain passage for closing said drain passage.

6. The dining garment of claim 1, wherein said drain passage comprises:

a nipple and cap assembly disposed at an outlet portion of said drain passage for closing said drain passage.

7. The dining garment of claim 1, wherein said drain passage comprises:

a drain outlet valve for closing said drain passage selected from the group consisting of spigot, valve, tap, faucet, stopper, and petcock.

8. The dining garment of claim 1, further comprising:

an apron of said cover having an elastic edge for securing said tray cover around and under the edge of said tray.

9. A dining garment for a child's high chair, comprising:

a tray cover shaped conformably to the outline of a tray of said high chair and covering said tray;

a bib extension of said tray cover extending upward from a rearward side of said tray cover;

a bolster disposed around and extending upward from the perimeter of the tray cover on the left, forward, and right sides thereof, wherein a first end and a second end of said bolster are attached to said bib extension at respective left and right sides thereof;

a trough formed along a rearward edge of said tray cover and disposed between said tray cover and a lower portion of said bib extension;

a drain passage disposed in a lower portion of said trough; and an apron of said cover having an elastic edge for securing said tray cover around and under the edge of said tray.

10. The dining garment of claim 9, wherein:

a basin is formed by said tray cover, bolster and bib extension.

11. The dining garment of claim 9, wherein said drain passage comprises:

a spout and plug assembly disposed at an outlet portion of said drain passage for closing said drain passage.

12. The dining garment of claim 9, wherein said drain passage comprises:

a nipple and cap assembly disposed at an outlet portion of said drain passage for closing said drain passage.

13. The dining garment of claim 9, wherein said drain passage comprises:

a drain outlet valve for closing said drain passage selected from the group consisting of spigot, valve, tap, faucet, stopper, and petcock.

14. The dining garment of claim 9, wherein: said bolster has sufficient rigidity as a frame to maintain said basin form while retaining sufficient flexibility to facilitate installation, removal, and cleaning of said cover, without requiring inflation of said bolster.

15. A dining garment for a child's high chair, comprising:

a tray cover shaped conformably to the outline of a tray of said high chair and covering said tray;

a bib extension of said tray cover extending upward from a rearward side of said tray cover;

a bolster disposed around and extending upward from the perimeter of the tray cover on the left, forward, and right sides thereof, wherein a first end and a second end of said bolster are attached to said bib extension at respective left and right sides thereof;

a trough formed along a rearward edge of said tray cover and disposed between said tray cover and a lower portion of said bib extension; and a drain passage disposed in a lower portion of said trough;

wherein said tray cover, bib extension and bolster are formed of a water repellant fabric, said bolster given form by a resilient stuffing material disposed therewithin.

16. The dining garment of claim 15, wherein: said trough is formed of a water repellant fabric.

* * * * *